US010717088B2

(12) United States Patent
Galaka et al.

(10) Patent No.: US 10,717,088 B2
(45) Date of Patent: Jul. 21, 2020

(54) MULTIFUNCTIONAL HYDRODYNAMIC VORTEX REACTOR

(71) Applicants: Oleksandr Galaka, Kyiv (UA); Oleksandr Kozlovskyi, Kyiv (UA); Yurii Matvienko, Kyiv (UA)

(72) Inventors: Oleksandr Galaka, Kyiv (UA); Oleksandr Kozlovskyi, Kyiv (UA); Yurii Matvienko, Kyiv (UA)

( * ) Notice: Subject to any disclaimer, the term of this patent is extended or adjusted under 35 U.S.C. 154(b) by 384 days.

(21) Appl. No.: 15/429,380

(22) Filed: Feb. 10, 2017

(65) Prior Publication Data

US 2017/0239629 A1 Aug. 24, 2017

Related U.S. Application Data

(60) Provisional application No. 62/298,101, filed on Feb. 22, 2016.

(51) Int. Cl.

| | |
|---|---|
| ***B01F 3/08*** | (2006.01) |
| ***B02C 19/00*** | (2006.01) |
| ***B01F 3/12*** | (2006.01) |
| ***B01F 5/00*** | (2006.01) |

(52) U.S. Cl.

CPC ..... *B02C 19/005* (2013.01); *B01F 3/0807* (2013.01); *B01F 3/12* (2013.01); *B01F 5/0074* (2013.01)

(58) Field of Classification Search

CPC ..... F26B 17/107; B02C 19/005; B02C 19/00; B01F 3/0807; B01F 3/12; B01F 5/0074; B01F 5/0057; B01F 5/00; B01F 3/08

USPC ..... 241/1, 5, 301, 39–40

See application file for complete search history.

(56) References Cited

U.S. PATENT DOCUMENTS

| | | | | |
|---|---|---|---|---|
| 3,425,545 A * | 2/1969 | Fellegi | D21D 5/18 | 209/2 |
| 3,462,086 A * | 8/1969 | Bertrand | B02C 19/061 | 241/5 |
| 3,614,069 A * | 10/1971 | Murry | B01F 11/0208 | 366/108 |
| 3,768,172 A * | 10/1973 | Klein | F26B 17/107 | 34/594 |
| 4,343,772 A * | 8/1982 | Frosch | B01J 6/008 | 422/200 |

(Continued)

*Primary Examiner* — Kenneth E Peterson
*Assistant Examiner* — Nhat Chieu Q Do
(74) *Attorney, Agent, or Firm* — Aleksandr Smushkovich

(57) ABSTRACT

A GMK-reactor includes —a housing, —a hollow base attached to the housing; an inverse taper narrowing downward and attached to the top of housing, —a supporting tube passing through the base including an upper portion situated inside the housing and a bottom discharge opening, —a number of washers of predetermined shapes mounted on an outer surface of the upper portion of the supporting tube such that outer edges of the washer and the inner sidewalls of the housing form predetermined gaps therebetween, and —a number of inlets tangentially attached to the base for introducing a substance and a liquid thereinto forming a circulating suspension therein. The suspension flow, under external pressure, takes a vortex, laminar or turbulent form, rises along inner sidewalls of the housing, enters the gaps, changing its direction at the inverse taper, thus forming a cavitation zone, providing for grinding, or/and mixing of the suspension.

3 Claims, 3 Drawing Sheets

(56) References Cited

U.S. PATENT DOCUMENTS

| | | | | |
|---|---|---|---|---|
| 8,771,524 | B2 * | 7/2014 | Vorage | B01F 3/0861 210/512.1 |
| 2005/0051649 | A1 * | 3/2005 | Taketomi | B02C 19/063 241/39 |
| 2009/0201760 | A1 * | 8/2009 | Vorage | B01F 3/0861 366/163.1 |
| 2010/0065669 | A1 * | 3/2010 | Coles | A23B 4/031 241/5 |
| 2018/0185796 | A1 * | 7/2018 | Eichenlaub | B01F 5/0074 |

* cited by examiner

MULTIFUNCTIONAL HYDRODYNAMIC VORTEX REACTOR

CROSS-REFERENCES TO RELATED APPLICATIONS

The present patent application claims the benefit of a U.S. provisional patent application Ser. No. 62/298,101 filed on Feb. 22, 2016, the disclosure of which is incorporated herein in its entirety by reference.

FIELD OF THE INVENTION

The present invention relates to the field of machine building and such machines can be used for:

- producing of fine suspensions in liquid-solid systems at production of fertilizers, biological additives, dyes, mortars, etc.;
- producing of fine emulsions and solutions in liquid-liquid systems for preparation of fuel mixtures, lubricant and cooling liquids, cosmetic and drug preparations, and food products;
- intensification of chemical and physical processes in liquids;
- water purification by mechanical destruction of bacteriological microflora;
- pasteurizing of food liquids mechanically at low temperatures;
- water ionization with a simultaneous introduction of required metal ions thereinto; and
- heating of fluids due to hydrodynamic effects.

Such machines, as a rule, use cavitation processes.

BACKGROUND OF THE INVENTION

Nowadays, about 20% of electrical energy produced in the world is consumed during the process of grinding of different substances. Development of nanotechnologies stimulates growth of such tendency and, at the same time, requires more energy-saving solutions. Use of GMK-reactor (named after the instant inventors: Galaka—Matvienko—Kozlovskyi) allows receiving nano-sized particles from different types of materials by means of simple method of grinding with substantial energy saving (from 7 to 60%) per one produced unit.

There are known various machines used for the above mentioned purposes. For example, U.S. Pat. No. 3,614,069 teaches "Method and apparatus for obtaining a state of cavitation, emulsification and mixing wherein materials are subjected to a band of ultrasonic frequencies which are gradually shifted downwardly to cause bubbles in the material to grow and then applying a second set of ultrasonic frequencies but of a much lower frequency and of a higher intensity than the first ultrasonic frequencies for causing the bubbles to expand to a size such that catastrophic collapse takes place. The low-frequency ultrasound is also varied in frequency so as to cause the bubbles to collapse and implode. In this case, the lower frequency is caused to increase in frequency by periodically sweeping the lower frequency upward. The method and apparatus provide improved cavitation, emulsification and mixing of substances as, for example, water-in-oil."

OBJECT AND BRIEF SUMMARY OF THE INVENTION

The object of the invention is to provide a multifunctional hydrodynamic vortex type reactor (herein also called a "GMK reactor") having a high degree of mixture dispersion (up to the nanoscale) due to simultaneous use of different physical processes.

This task is accomplished by implementation of the following physical processes taking place in the inventive GMK-reactor: simultaneous formation of turbulent, vortex and laminar fluid flows; creating conditions for cavitation with different hardness, resulting in occurrence of cavitation cumulative jets, ultrasonic and shock waves, as well as ionization.

Therefore, according to a preferred embodiment of the invention, a multifunctional hydrodynamic vortex type reactor (herein also called a 'GMK-reactor') for grinding a substance, or mixing a substance with a liquid, the GMK-reactor comprising: —a housing defining at least a top, a bottom, and inner sidewalls thereof; —a hollow base attached to the bottom of the housing; an inverse taper narrowing downward, situated inside the housing, and having an upper inner portion attached to the top of the housing; —a supporting tube passing through the base; the supporting tube includes an upper portion situated inside the housing, a lower portion situated below the base, and a discharge opening situated at a bottom of the lower portion of the supporting tube; —at least one washer (or a plurality of washers) mounted on an outer surface of the upper portion of the supporting tube such that outer edges of the at least one washer and the inner sidewalls of the housing form predetermined gaps therebetween; and—at least one inlet (or a number of inlets) tangentially attached to the base for introducing at least the substance into the base providing for the grinding, or the mixing, or both.

DRAWINGS OF THE INVENTION

The drawings in FIGS. 1-3 illustrate the invention. In particular:

BRIEF DESCRIPTION OF PREFERRED EMBODIMENTS OF THE INVENTION

Figure 1:
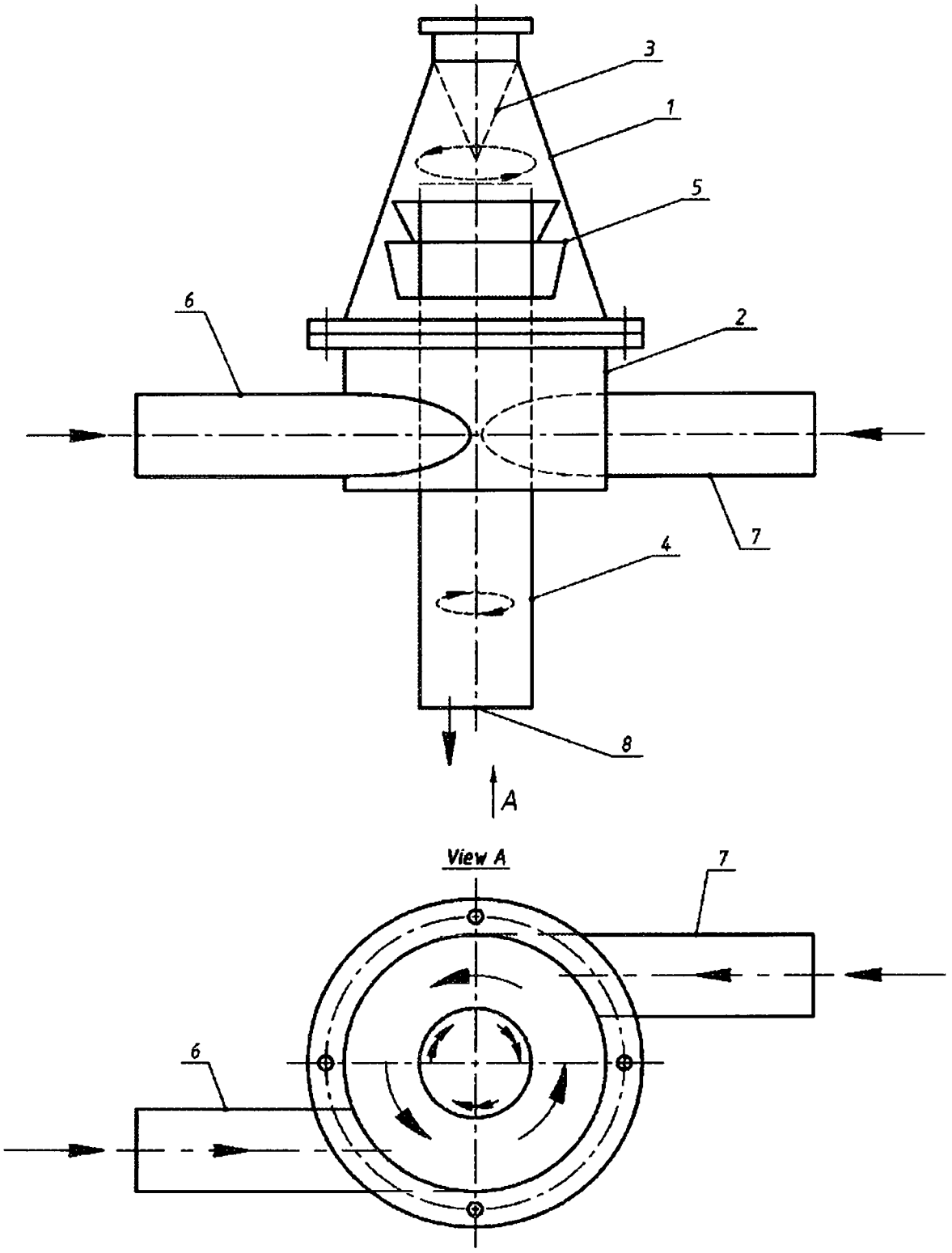
FIG. 1 illustrates a frontal projection and a plan projection of the GMK reactor, according to a preferred embodiment of the present invention.

While the invention may be susceptible to embodiment in different forms, there is shown in the drawing, and will be described in detail herein, a specific exemplary embodiment of the present invention, with the understanding that the present disclosure is to be considered an exemplification of the principles of the invention, and is not intended to limit the invention to that as illustrated and described herein.

According to a preferred embodiment, the inventive GMK-reactor comprises: a housing 1 (preferably of a conical shape); a base 2 (preferably of a cylindrical shape) attached to the bottom of housing 1; an inverse taper 3 narrowing downward with its upper inner portion attached to the top of housing 1 preferably by means of a threaded joint; a supporting pipe 4 passing through the base 2, while an upper portion of supporting tube 4 is situated inside the housing 1; and a set of washers 5 mounted on the outer surface of the upper portion of supporting tube 4 such that the outer edges of washers 5 and the inner sidewalls of housing 1 form predetermined gaps.

Figure 2:
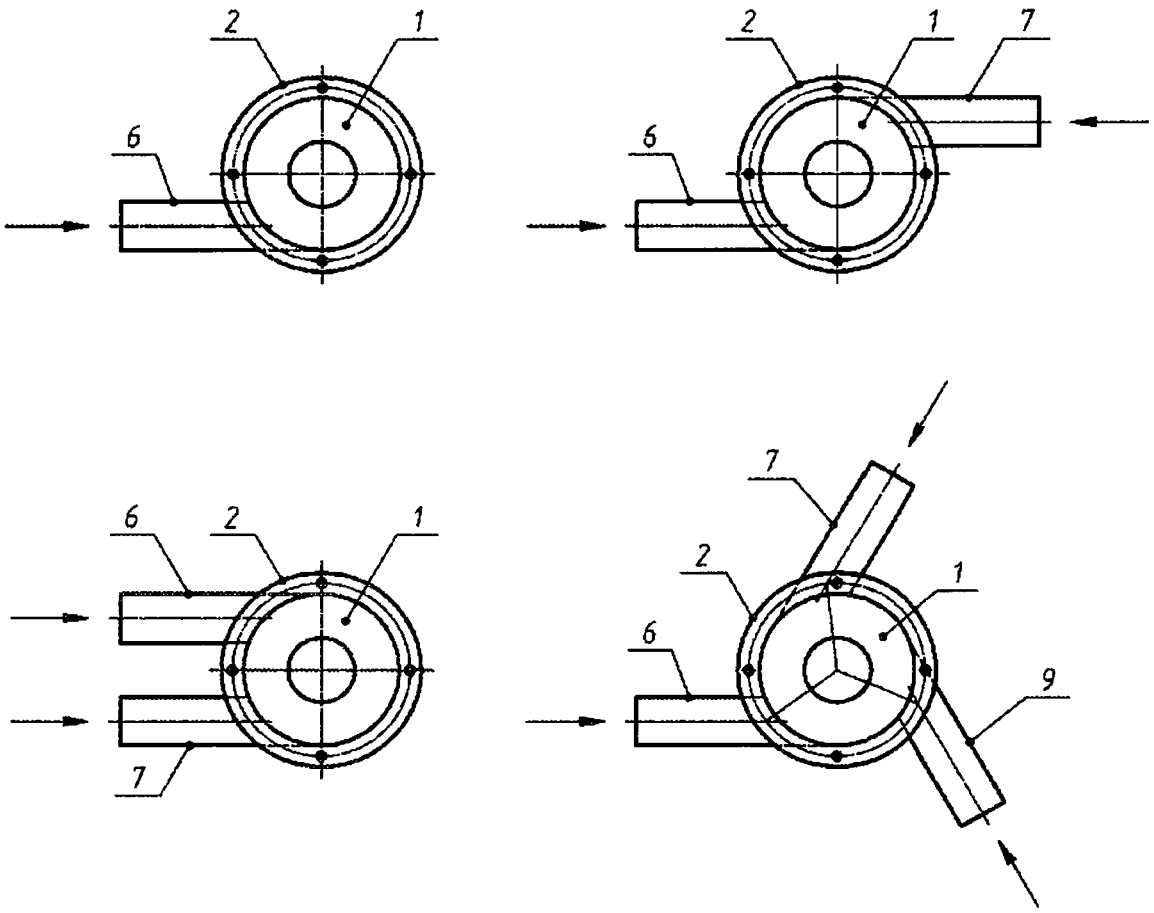
FIG. 2 illustrates frontal projections of three optional configurations of washers of the GMK reactor, according to a preferred embodiment of the present invention.

The supporting tube 4 in conjunction with the inverse taper 3 and the set of washers 5 are provided for structuring the process of fluid flow and cavitation within the GMK-reactor. The washers 5, depending on the nature of substance treatment in the GMK-reactor, may have various configurations: 5(*a*), 5(*b*) and 5(*c*), as shown in FIG. 2. Discharge of the fluid flow from the GMK-reactor is achieved through a discharge opening 8 situated at the bottom of supporting tube 4, as shown in FIG. 1.

The diameter and height of the housing 1, the diameter of the base 2, and the diameter of the supporting tube 4 are calculation values and can be predetermined for a particular embodiment of the invention, which depends on characteristics of the substance to be ground or mixed within the GMK-reactor, the required size of ground particles, and the particular shape of the GMK-reactor.

Figure 3:
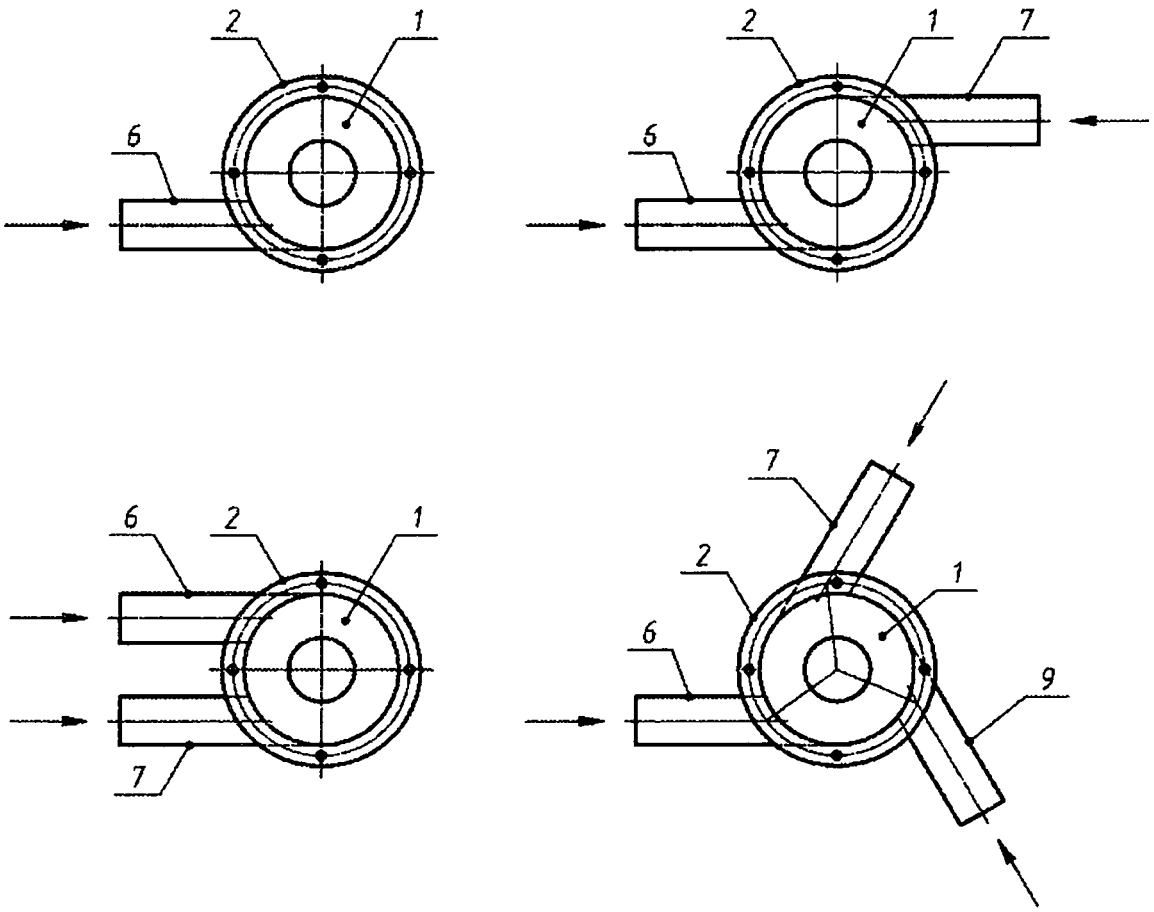
FIG. 3 illustrates frontal projections of four optional configurations of a base of the GMK reactor, according to a preferred embodiment of the present invention.

The base 2 of the GMK reactor, depending on particular purposes of grinding or mixing, can have a single inlet 6 (see FIG. 3), or multiple tangential inlets 6, 7 and 9, which may be aligned in the same direction or in different directions (including the opposite direction) as shown in FIG. 3.

A size of the washers 5 providing the cavitation process depends on the size (linear and angular dimensions) and configuration of the housing 1, the configuration of washers 5, and their design is determined depending on cavitation modes required.

The design of GMK-reactor comprises no moving parts, which significantly simplifies its production, increases the reliability, and extends its operational lifespan.

Liquid is introduced into the base 2 at a certain pressure, for example, through a tangential inlet 6 (FIG. 1). A solution containing a substance to be ground and/or mixed in the GMK-reactor is introduced through the inlet 7. Depending on the physical characteristics of the substance to be ground or mixed, the aforesaid substance can be fed into the GMK-reactor in a liquid form, or, for example, in a dry form through the inlet 7 using an appropriate known ejector.

The liquid flow, under external pressure and due to the design of the base 2, takes a vortex, laminar or turbulent form. Then the mixed flow (i.e. a mixture of the substance and liquid introduced via the inlets 6 and 7), rising along the inner sidewalls of the housing 1, enters into the gaps between the inner sidewalls of housing 1 and the outer edges of washers 5 thus forming a cavitation zone.

Cavitation modes, depending on the characteristics of the substance to be ground/mixed, are determined by a selection of configurations of the washers 5. Having passed the cavitation zone, the flow rises to the inverse taper 3, and then changes its direction of circulation to the opposite one (this effect is also known as a gyratory motion along inner sidewalls of a chamber; it was observed by the instant inventors), while maintaining the character of vortex motion. Upon the reversal of the flow circulation, the most intensive grinding/mixing of the substance occurs due to a mutual collision of particles in the fluid flows moving in the opposite directions.

The so treated fluid flow is discharged through the supporting pipe 4. To obtain a required result of grinding/mixing, the treatment process in the GMK-reactor is cycled during a predetermined time.

Thus, the treatment of the flow passing through the GMK-reactor results in dispersion of the suspension containing the substance and liquid, providing a reduction of the size of the substance's particles to nanometers.

The GMK-reactor operates as follows. Before launching, a suspension of liquids and a substance to be ground is prepared in a separate container, while the suspension has a concentration required by technology of the process. The liquid is fed to the inlet 6 under pressure, and the suspension, prepared in the container, is fed into the inlet 7 at the same time (shown in FIG. 1).

At the base 2, these two flows are mixed and a resultant flow takes a vortex turbulent form (the direction of liquid flow in the lower and middle parts of housing 1 is shown in FIG. 1 by ordinary arrows) due to the design of GMK-reactor. Further, under the influence of centrifugal force, the flow rises along the inner sidewall of the housing 1, while generating a cavitation process on the washers 5, achieving intensive grinding/mixing of the substance.

Upon rising to the upper part of the housing, the liquid flow turns back in the opposite direction (the direction of liquid flow in the upper part of housing 1 is shown in FIG. 1 by double arrows) forming a counter-flow, while maintaining the character of the vortex motion. After turning back at 180° of the rotating liquid flow, an intensive grinding of the substance particles occurs due to their mutual collision produced by moving of the flow and the counter flow. The intensity of interaction of the two flows in the aforesaid GMK-reactor zone depends on the configuration of the inverse taper 3.

Upon passing through the GMK-reactor, the so treated flow is discharged through the discharge opening 8. The treatment time of particular substance depends on its physical characteristics and requirements for its grinding/mixing, as well as on the pressure of the fluid flow at the inlet.

We claim:

1. A multifunctional hydrodynamic vortex type reactor for mixing a solid substance with a liquid and grinding the solid substance, said multifunctional hydrodynamic vortex type reactor comprising:

a housing (1) having a conical section defining at least a top, a bottom, and inner sidewalls thereof;

a hollow base (2) attached to the bottom of said conical section of the housing (1);

an immovable inverse taper (3) narrowing downward, the inverse taper (3) is situated inside the conical section of the housing (1), the inverse taper (3) has an upper inner portion attached to the top of said conical section of the housing (1):

a supporting tube (4) passing through the base (2); said supporting tube (4) includes an upper portion situated inside the conical section of the housing (1), a lower portion situated below the base (2), and a discharge opening (8) situated at a bottom of the lower portion of said supporting tube (4);

at least one washer (5) having a conical external surface and mounted on an outer surface of the upper portion of said supporting tube (4) such that outer edges of said at least one washer (5) and the inner sidewalls of said conical section of the housing (1) form a predetermined horizontal gap therebetween to achieve intensive grinding and mixing of the substance; and at least one inlet tangentially attached to the base (2) for introducing at least said solid substance into the base (2) providing for said mixing and grinding.

2. The multifunctional hydrodynamic vortex type reactor according to claim 1, wherein said at least one inlet further includes a first inlet (6) for introducing at least said solid substance into the base (2) and a second inlet (7) for introducing said liquid into the base (2), such that the solid substance and the liquid form a suspension circulating inside the base (2) in a predetermined direction.

3. The multifunctional hydrodynamic vortex type reactor according to claim 2, wherein said at least one washer (5) further includes a plurality of washers of predetermined shapes.

* * * * *